US011085608B2

(12) United States Patent
Shin

(10) Patent No.: US 11,085,608 B2
(45) Date of Patent: Aug. 10, 2021

(54) LIGHTING DEVICE

(71) Applicant: AMOSENSE CO., LTD., Cheonan-si (KR)

(72) Inventor: Gyu Weon Shin, Daejeon (KR)

(73) Assignee: AMOSENSE CO., LTD, Cheonan-si (KR)

( * ) Notice: Subject to any disclaimer, the term of this patent is extended or adjusted under 35 U.S.C. 154(b) by 0 days.

(21) Appl. No.: 16/961,193

(22) PCT Filed: Jan. 8, 2019

(86) PCT No.: PCT/KR2019/000263
§ 371 (c)(1),
(2) Date: Jul. 9, 2020

(87) PCT Pub. No.: WO2019/139328
PCT Pub. Date: Jul. 18, 2019

(65) Prior Publication Data

US 2021/0054984 A1 Feb. 25, 2021

(30) Foreign Application Priority Data

Jan. 10, 2018 (KR) ..... 10-2018-0003316

(51) Int. Cl.

| | |
|---|---|
| ***F21V 5/00*** | (2018.01) |
| ***F21V 29/76*** | (2015.01) |
| ***F21V 23/00*** | (2015.01) |
| ***F21V 23/04*** | (2006.01) |
| ***F21Y 115/10*** | (2016.01) |

(52) U.S. Cl.
CPC ..... *F21V 5/007* (2013.01); *F21V 23/003* (2013.01); *F21V 23/0464* (2013.01); *F21V 29/763* (2015.01); *F21Y 2115/10* (2016.08)

(58) Field of Classification Search
CPC ..... F21V 5/007; F21V 29/763; F21V 23/003; F21V 23/0464; F21Y 2115/10
See application file for complete search history.

(56) References Cited

U.S. PATENT DOCUMENTS

2013/0257297 A1* 10/2013 Schmidt ..... H05B 35/00 315/182
2018/0020531 A1* 1/2018 Fultz ..... H02M 7/003

FOREIGN PATENT DOCUMENTS

| | | | |
|---|---|---|---|
| JP | 2012-9286 | A | 1/2011 |
| KR | 10-2009-0102169 | A | 9/2009 |
| KR | 10-1039035 | B1 | 6/2011 |
| KR | 10-2012-0140033 | A | 12/2012 |

(Continued)

*Primary Examiner* — Mary Ellen Bowman
(74) *Attorney, Agent, or Firm* — Maschoff Brennan

(57) ABSTRACT

A lighting device includes: a circuit board; a first light emitting diode array and a second light emitting diode array; and a driving circuit. The first light emitting diode array and the second light emitting diode array are mounted on the circuit board so as to generate light, the first light emitting diode array is disposed on the circuit board, and the second light emitting diode array is disposed on the circuit board apart from the first light emitting diode array. The driving circuit is mounted on the circuit board so as to generate an electrical signal for driving the first light emitting diode array and the second light emitting diode array, and the driving circuit is disposed between the first light emitting diode array and the second light emitting diode array.

9 Claims, 6 Drawing Sheets

(56) References Cited

FOREIGN PATENT DOCUMENTS

| | | | |
|---|---|---|---|
| KR | 10-1243153 | B1 | 3/2013 |
| KR | 10-2014-0120129 | A | 10/2014 |
| KR | 10-1761560 | B | 7/2017 |

* cited by examiner

[FIG. 1]
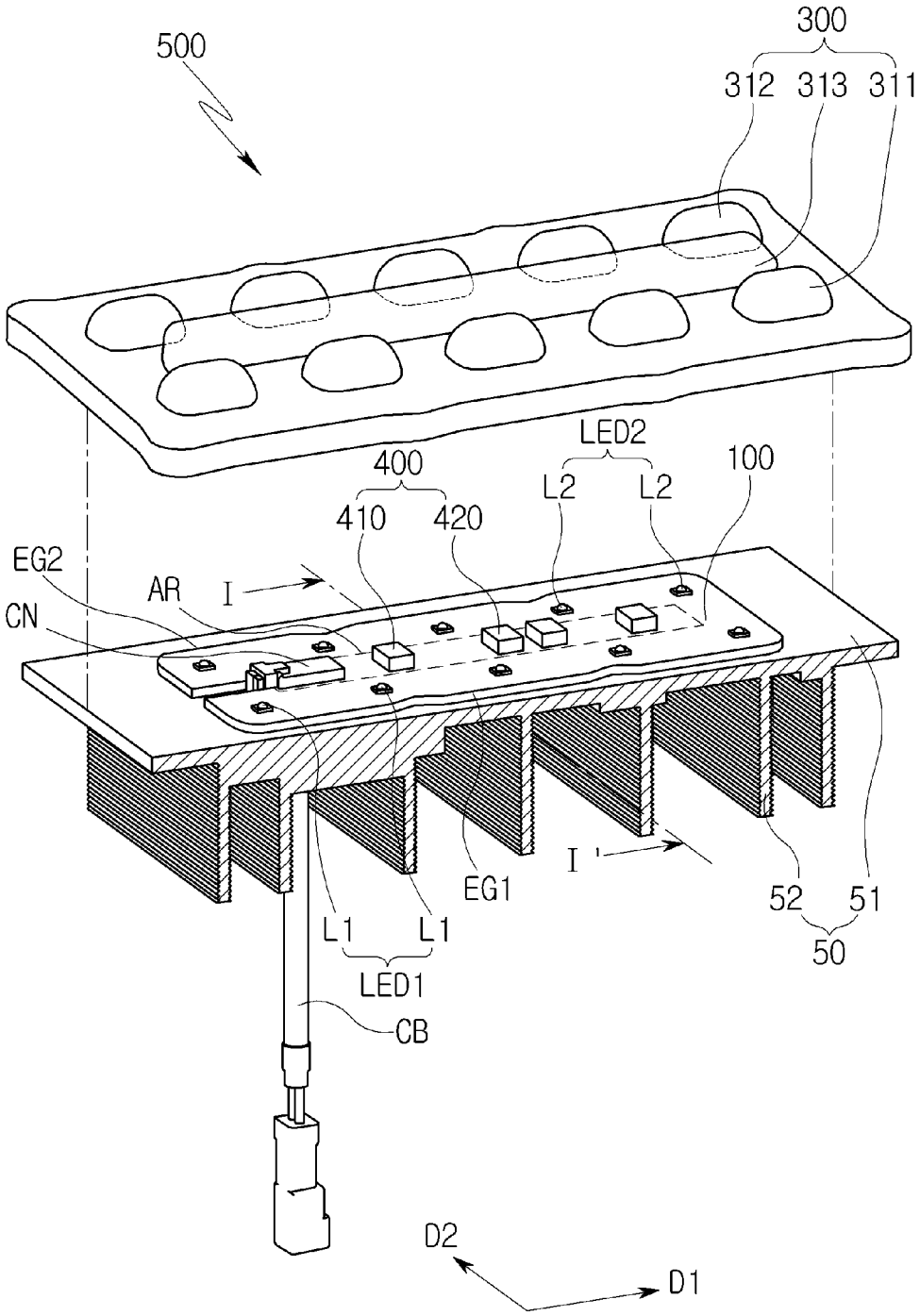

[FIG. 2]
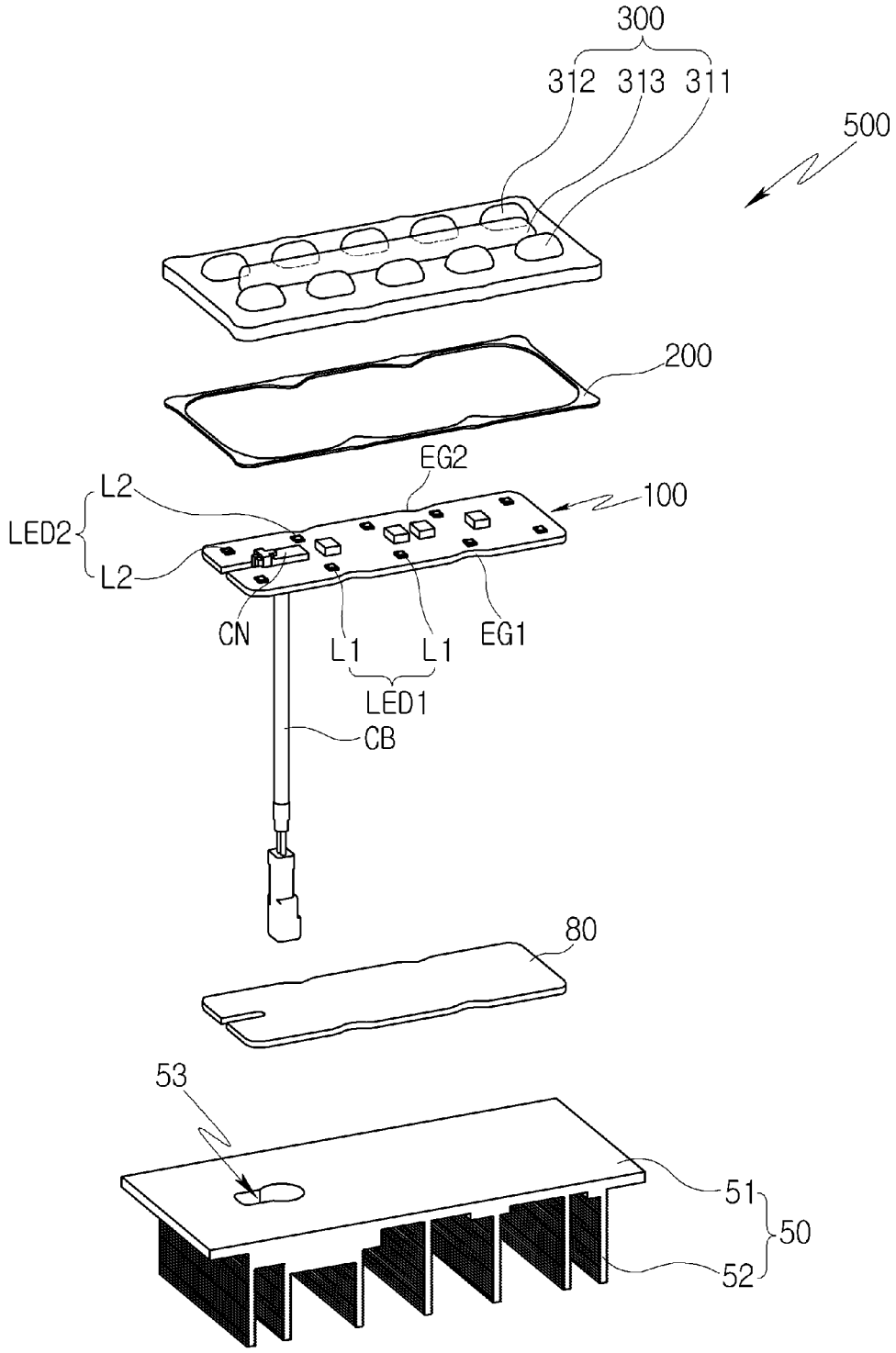

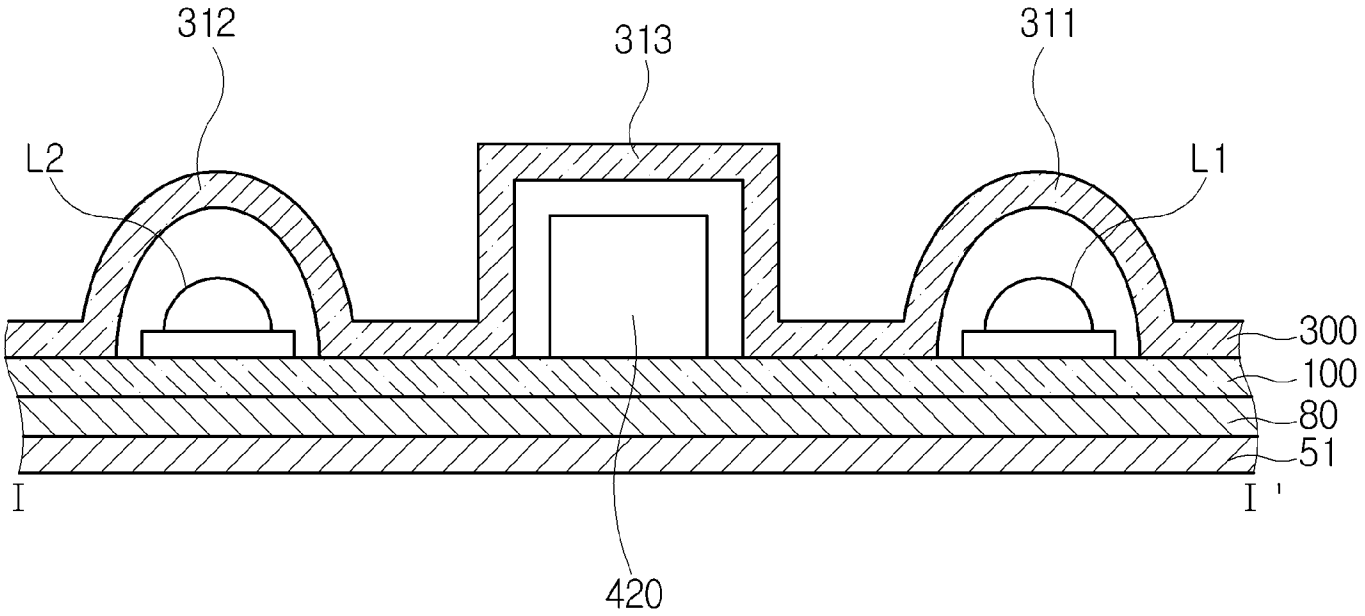
[FIG. 3]

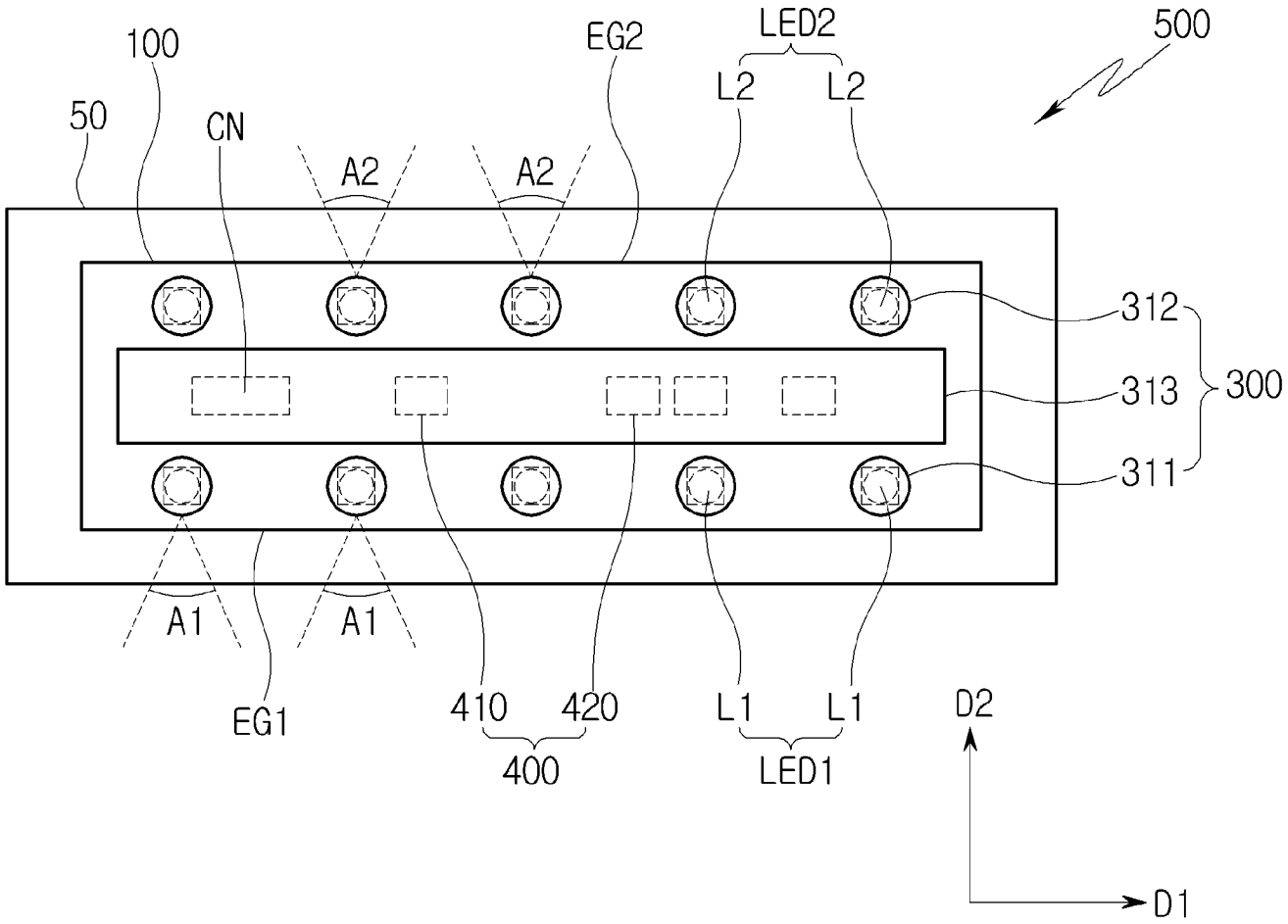
[FIG. 4]

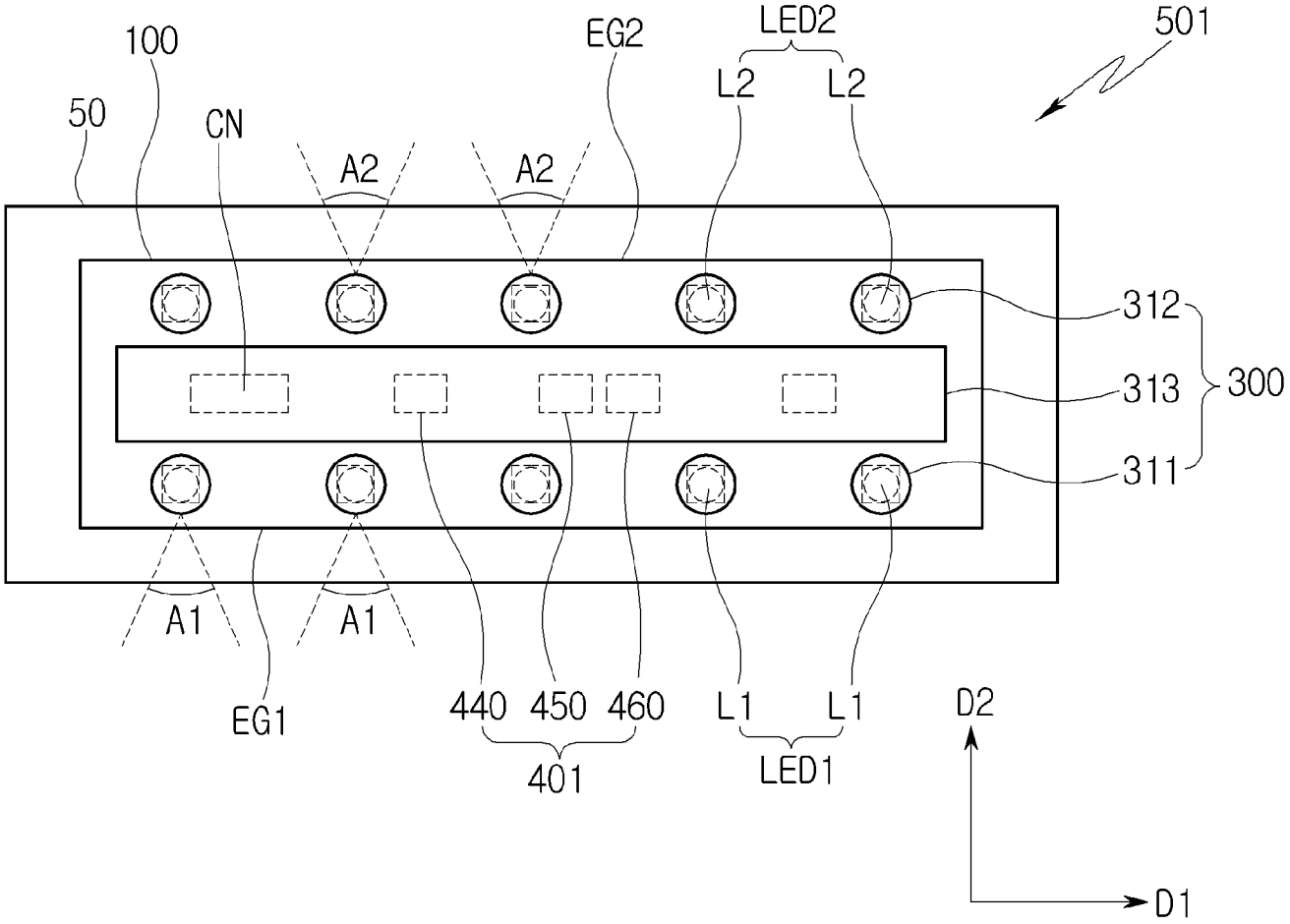
[FIG. 5]

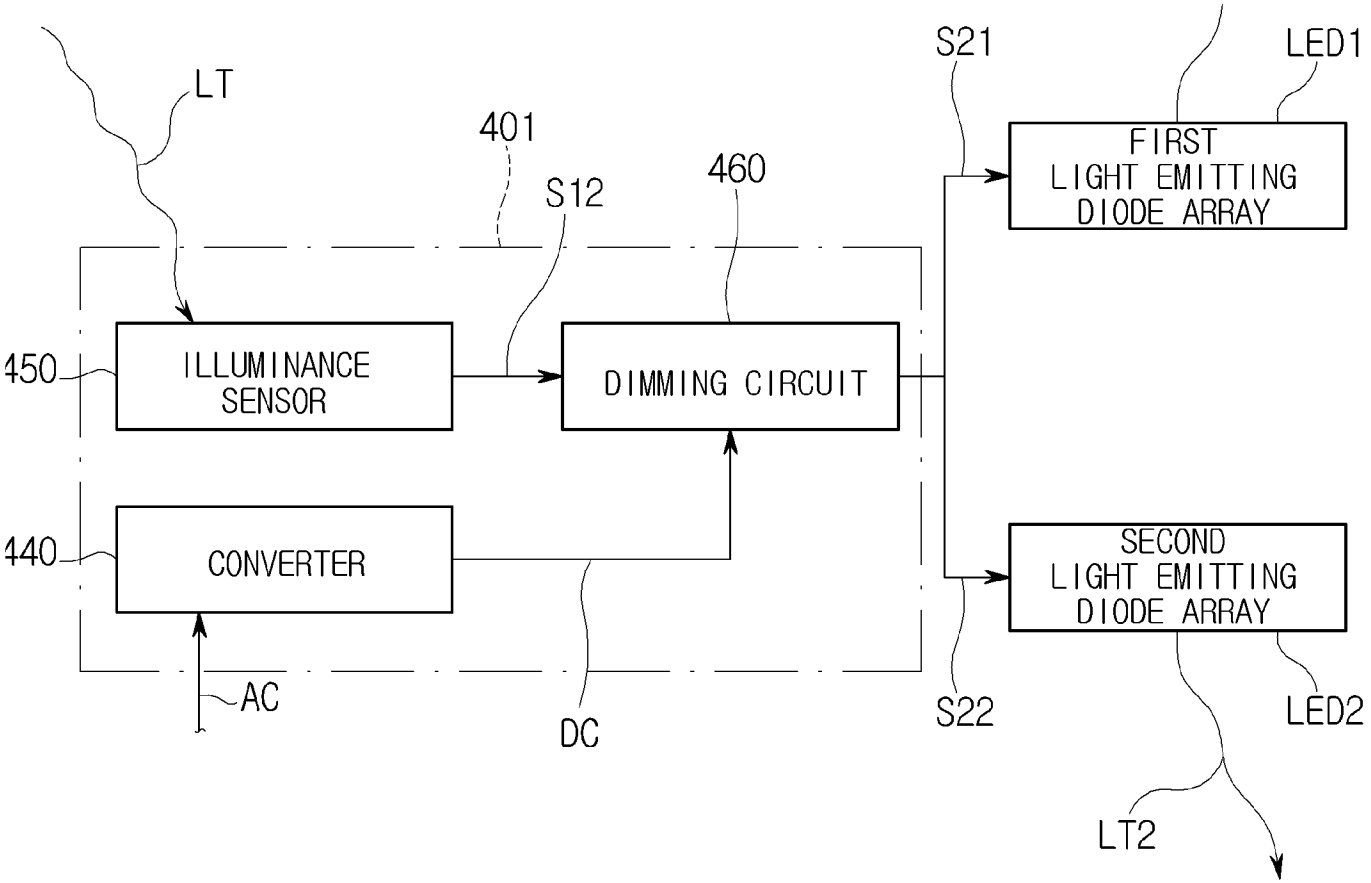
[FIG. 6]

LIGHTING DEVICE

TECHNICAL FIELD

The present disclosure relates to a lighting device, and more particularly, to a lighting device having a light emitting diode as a light source.

BACKGROUND ART

Recently, a light emitting diode has been widely used as a light source for a lighting device. The light emitting diode is an element which converts electrical energy into light energy, and may implement relatively improved luminance at a lower power as compared with a light source using a conventional filament.

Meanwhile, since a directing angle of the light emitted from the light emitting diode is limited, it may be advantageous for the lighting device such as a plurality of street lights installed on the road to have a wide light irradiation range in terms of cost. Accordingly, even if the number of light emitting diodes in the lighting device or the size of the lighting device is not increased, methods which may expand a light irradiation range of the lighting device have been studied.

DISCLOSURE

Technical Problem

An object of the present disclosure is to provide a lighting device having a structure which is advantageous for expanding an irradiation range of light.

Technical Solution

For achieving the object of the present disclosure, a lighting device according to the present disclosure includes a circuit board, a first light emitting diode array, a second light emitting diode array, and a driving circuit.

The first light emitting diode array is mounted on the circuit board to generate light, and the first light emitting diode array is arranged on the circuit board. The second light emitting diode array is mounted on the circuit board to generate light, and the second light emitting diode array is arranged on the circuit board apart from the first light emitting diode array.

The driving circuit is mounted on the circuit board to generate an electrical signal for driving the first light emitting diode array and the second light emitting diode array. Further, the driving circuit is disposed between the first light emitting diode array and the second light emitting diode array.

In an exemplary embodiment of the present disclosure, the first light emitting diode array may include first light emitting diodes which are arranged along a first side adjacently to a first side of the circuit board. Further, the second light emitting diode array may include second light emitting diodes which are arranged along a second side adjacently to a second side of the circuit board opposite to the first side.

In an exemplary embodiment of the present disclosure, the first light emitting diodes may be arranged in a longitudinal direction of the circuit board adjacently to the first side, and the second light emitting diodes may be arranged in the longitudinal direction of the circuit board adjacently to the second side.

In an exemplary embodiment of the present disclosure, the driving circuit may include a Rectifier circuit which rectifies an external power into a direct current power.

In an exemplary embodiment of the present disclosure, the lighting device may further include a connector which is disposed on the circuit board. The connector is electrically connected to the Rectifier circuit, and the connector is disposed between the first light emitting diode array and the second light emitting diode array.

In an exemplary embodiment of the present disclosure, the driving circuit may include a converter which converts an alternating current power provided from the outside into a direct current power of a rated voltage.

In an exemplary embodiment of the present disclosure, the driving circuit may include an illuminance sensor and a dimming circuit. The illuminance sensor senses an external illuminance, and the dimming circuit controls the illuminance of the light emitted from the first light emitting diode array and the second light emitting diode array. Further, the dimming circuit controls the illuminance of the light emitted from the first light emitting diode array and the second light emitting diode array based on information of the external illuminance sensed by the illuminance sensor.

Advantageous Effects

According to the present disclosure, even if the light emitting diodes are mounted on the circuit board together with the driving circuit, the light emitted from the light emitting diodes may be prevented from interfering with the driving circuit in the process of emitting the light to the outside of the lighting device. Accordingly, when the lighting device is configured using the light emitting diodes, the loss of the original directing angle of each of the light emitting diodes may be minimized, thereby maximally implementing the irradiation range of the lighting device.

Further, according to the present disclosure, the irradiation range of the lighting device may be expanded without increasing the separation distance between the light emitting diode and the driving circuit in the circuit board. Accordingly, it is possible to provide the lighting device having the structure which is advantageous for decreasing the size of the lighting device.

DESCRIPTION OF DRAWINGS

FIG. 1 is a perspective diagram of a lighting device according to an exemplary embodiment of the present disclosure.

FIG. 2 is an exploded perspective diagram of the lighting device illustrated in FIG. 1.

FIG. 3 is a cross-sectional diagram illustrating the surface taken along the line I-I' illustrated in FIG. 1.

FIG. 4 is a plan diagram of the lighting device illustrated in FIG. 1.

FIG. 5 is a plan diagram of the lighting device according to another exemplary embodiment of the present disclosure.

FIG. 6 is a block diagram illustrating a function of a driving circuit illustrated in FIG. 5.

MODE FOR INVENTION

Hereinafter, exemplary embodiments of the present disclosure will be described in detail with reference to the accompanying drawings. The objects, features, and effects of the present disclosure described above may be understood through exemplary embodiments related to the drawings.

However, the present disclosure is not limited to the exemplary embodiments described herein, and may also be applied and modified in various forms. Rather, the exemplary embodiments of the present disclosure to be described later are provided to clarify the technical spirit disclosed by the present disclosure more clearly, and furthermore to sufficiently convey the technical spirit of the present disclosure to those skilled in the art to which the present disclosure pertains. Accordingly, it should not be construed that the scope of the present disclosure is limited by the exemplary embodiments to be described later. Meanwhile, the same reference numerals in the following examples and drawings denote the same components.

Further, terms such as 'first' and 'second' in the present specification have no limited meanings and are used for the purpose of distinguishing one component from another component. Further, when a portion such as a film, a region, or a component is referred to as being "above" or "on" another portion, this includes not only a case where the portion is located directly on another portion, but also a case where other films, regions, components, and the like are interposed therebetween.

Referring to FIGS. 1 and 2, a lighting device 500 includes a circuit board 100, a first light emitting diode array LED1, a second light emitting diode array LED2, a lens cover 300, a driving circuit 400, a connector CN, a thermal pad 80, a sealing member 200, and a heat sink 50.

The circuit board 100 may be a printed circuit board, and the circuit board 100 includes a base board and a circuit pattern which is printed on the base board. In the present exemplary embodiment, the circuit board 100 may be a metal printed circuit board. Accordingly, heat generated from first and second light emitting diodes L1, L2 may be easily transferred to the heat sink 50 through the circuit board 100.

The first light emitting diode array LED1 includes the first light emitting diodes L1 and the second light emitting diode array LED2 includes the second light emitting diodes L2. The first light emitting diodes L1 and the second light emitting diodes L2 are mounted on the circuit board 100 and electrically connected to circuit patterns of the circuit board 100. The first light emitting diodes L1 and the second light emitting diodes L2 generate light in response to a power signal which is provided from the outside through the connector CN.

In the present exemplary embodiment, the first light emitting diodes L1 may be arranged along a first side EG1 of the circuit board 100 adjacently to the first side EG1, and the second light emitting diodes L2 may be arranged along a second side EG2 adjacently to the second side EG2 facing the first side EG1 of the circuit board 100. Accordingly, like a first directing angle (A1 in FIG. 4) and a second directing angle (A2 in FIG. 4) illustrated in FIG. 4, the light emitted from the first light emitting diodes L1 may spread toward the outside of the circuit board 100 via the first side EG1 of the circuit board 100 on a plane, and the light emitted from the second light emitting diodes L2 may spread toward the outside of the circuit board 100 via the second side EG2 of the circuit board 100 on a plane.

In the present exemplary embodiment, the circuit board 100 may have a rectangular shape. In this case, the first side EG1 corresponds to a first long side of the circuit board 100 and a total of five first light emitting diodes L1 are arranged along the first long side. Further, the second side EG2 corresponds to a second long side opposite to the first long side of the circuit board 100 and a total of five second light emitting diodes LED2 are arranged along the second long side.

In the present exemplary embodiment, a total of 10 light emitting diodes of 2 rows and 5 columns are mounted on the circuit board 100, but in another exemplary embodiment, light emitting diodes may be mounted in a matrix shape having fewer or more rows and columns than 2 rows and 5 columns on the circuit board 100.

Further, when a longitudinal direction of the circuit board 100 is defined as a first direction D1 and a width direction of the circuit board 100 is defined as a second direction D2, the first light emitting diodes L1 are arranged in the first direction D1 adjacently to the first side EG1, and the second light emitting diodes L2 are arranged in the first direction D1 adjacently to the second side EG2.

The driving circuit 400 is mounted on the circuit board 100 together with the first light emitting diode arrays LED1 and the second light emitting diode arrays LED2. The driving circuit 400 generates electrical signals which drive the first and second light emitting diode arrays LED1, LED2.

The driving circuit 400 may include various electronic elements which are required to drive the first light emitting diode arrays LED1 and the second light emitting diode arrays LED2, and the present disclosure is not limited to the type of electronic elements included in the driving circuit 400.

In the present exemplary embodiment, the first light emitting diodes L1 and the second light emitting diodes L2 may be driven by an AC direct-type power supply, and in this case, the driving circuit 400 may include a Rectifier circuit 410 and a driving driver 420.

The AC power supplied from the outside through the connector CN is rectified to the DC power by the Rectifier circuit 410. Further, the rectified DC power is provided as a constant current source toward the first and second light emitting diodes L1, L2 through the driving driver 420.

In another exemplary embodiment, the driving circuit 400 may further include a capacitance, and the DC power rectified from the Rectifier circuit 410 may be smoothed by the capacitance.

The lens cover 300 is made of a material having a property of transmitting light. For example, the material of the lens cover 300 may contain a plastic such as poly methyl methacrylate (PMMA) and polycarbonate (PC), a glass, or a silicone. The lens cover 300 covers the first light emitting diode array LED1 and the second light emitting diode array LED2 to adjust a progressing direction of the light emitted from the first light emitting diodes L1 and the second light emitting diodes L2.

In the present exemplary embodiment, the lens cover 300 includes first optical lenses 311, second optical lenses 312, and a cover 313. The first optical lenses 311 cover the first light emitting diodes L1 to have a one-to-one correspondence with the first light emitting diodes L1, and the second optical lenses 312 cover the second light emitting diodes L2 to have a one-to-one correspondence with the second light emitting diodes L2.

In the present exemplary embodiment, each of the first and second optical lenses 311, 312 may have a convex lens shape. Accordingly, the light emitted to the outside through the first and second optical lenses 311, 312 spreads, and the irradiation range of the light output from the lighting device 500 may be extended.

The cover 313 covers the driving circuit 400. As illustrated in FIG. 3, the cover 313 may be defined by convexly protruding a portion of the lens cover 300 which corresponds to the location of the driving circuit 400. Further, since the driving circuit 400 is located in a space defined by the cover 313 in the lens cover 300, the driving circuit 400 may be covered by the cover 313.

In the present exemplary embodiment, the cover 313 may be formed integrally with the first and second optical lenses 311, 312. Accordingly, the lens cover 300 may have a plate shape having the size and shape substantially corresponding to that of the circuit board 100 to cover the circuit board 100. Accordingly, the lens cover 300 adjusts the progressing direction of the light emitted from the first light emitting diodes L1 and the second light emitting diodes L2, and at the same time, the lens cover 300 protects the circuit board 100 and the electronic elements mounted on the circuit board 100 from moisture, dust, and shock.

The thermal pad 80 is interposed between the circuit board 100 and the heat sink 50. The thermal pad 80 may be made of a metal such as aluminum or copper, or the thermal pad 80 may be made of a resin such as polycarbonate or epoxy. The thermal pad 80 transfers heat generated from the circuit board 100 and the driving circuit 400 toward the heat sink 50.

The sealing member 200 may be disposed on a contact surface between the lens cover 300 and the heat sink 50 at the rim side of the lens cover 300. As the sealing member 200, for example, an oring may be applied. In the state where the lens cover 300 and the heat sink 50 are coupled to each other, the sealing member 200 blocks moisture or external foreign substance which is introduced into the lens cover 300 through a gap between the lens cover 300 and the heat sink 50.

The heat sink 50 supports the rear surface of the circuit board 100 to directly or indirectly contact the circuit board 100. The heat sink 50 may be made of a metal such as aluminum and copper, and the heat sink 50 discharges heat generated from the circuit board 100 and the driving circuit 400 to the outside.

In the present exemplary embodiment, the heat sink 50 includes a heat-dissipating plate 51 and a plurality of heat-dissipating fins 52. The heat-dissipating plate 51 supports the circuit board 100, and a connector hole 53 which penetrates the heat-dissipating plate 51 is formed in the heat-dissipating plate 51. Accordingly, a cable CB electrically connected to the connector CN passes through the connector hole 53 and is taken out to the outside of the lighting device 500, and the cable CB taken out to the outside may be electrically connected to the external power supply apparatus.

The plurality of heat-dissipating fins 52 may be spaced apart from each other and coupled with the heat-dissipating plate 51. Each of the plurality of heat-dissipating fins 52 may have a shape protruding from the heat-dissipating plate 51 in one direction, and the plurality of heat-dissipating fins 52 may be spaced apart from each other while being in contact with the heat-dissipating plate 51. The surface area of the heat sink 50 is widened by the aforementioned structures of the heat-dissipating plate 51 and the plurality of heat-dissipating fins 52, such that the heat generated from the circuit board 100 and the driving circuit 400 may be easily discharged to the outside.

Meanwhile, as described above, the lighting device 500 according to the present exemplary embodiment includes the thermal pad 80, the sealing member 200, and the heat sink 50 as components, but the present disclosure is not limited to the structure of the thermal pad 80, the sealing member 200, and the heat sink 50. For example, in another exemplary embodiment, at least one of the thermal pad 80 and the sealing member 200 as components of the lighting device 500 may be omitted, and in still another exemplary embodiment, the heat sink 50 of the lighting device 500 may have a structure in which the heat-dissipating fins are omitted.

Hereinafter, a structure of the driving circuit 400 will be described in more detail further with reference to FIG. 4 as follows.

Referring to FIG. 4, the driving circuit 400 is disposed in a driving circuit area AR which is defined between the first side EG1 and the second side EG2 of the circuit board 100 and located between the first light emitting diode arrays LED1 and the second light emitting diode arrays LED2. Further, if the driving circuit 400 includes a plurality of electronic elements, that is, if the driving circuit 400 includes the Rectifier circuit 410 and the driving driver 420 as in the present exemplary embodiment, the Rectifier circuit 410 and the driving driver 420 are arranged between the first and second light emitting diode arrays LED1, LED2.

As described above, the effect generated by disposing the driving circuit 400, the first light emitting diode array LED1 and the second light emitting diode array LED2 in the circuit board 100 are as follows.

Most of the light emitted from the first and second light emitting diodes L1, L2 is emitted in a direction of spreading from the surface of the circuit board 100 toward the top of the circuit board 100, but in FIG. 5, a range in which the light emitted from each of the first light emitting diodes L1 on a plane is emitted toward the first side EG1 is illustrated by the first directing angle A1, and a range in which the light emitted from each of the second light emitting diodes L2 on a plane is emitted toward the second side EG2 is illustrated by the second directing angle A2.

If it is assumed that a plurality of lighting devices 500 are installed on the road extending in the first direction D1, an installation interval of the lighting device 500 may be defined by the first directing angle A1 of the first light emitting diodes L1 and the second directing angle A2 of the second light emitting diodes L2. Accordingly, in order to increase the installation interval of the lighting device 500, it may be important to expand the irradiation range of the light output from one lighting device 500 by sufficiently securing the size of each of the first directing angle A1 and the second directing angle A2.

Meanwhile, unlike the exemplary embodiment of the present disclosure, the driving circuit 400 is disposed closer to edges corresponding to two long sides of the circuit board 100 or edges corresponding to two short sides thereof than the first and second light emitting diode arrays LED1, LED2, the driving circuit 400 may be located on a path through which the light emitted from the first and second light emitting diodes L1, L2 proceeds to the outside of the lighting device 500. In this case, the light emitted from the first and second light emitting diodes L1, L2 interferes with the driving circuit 400 and the irradiation range of the light finally output from the lighting device 500 may be decreased. Otherwise, in order to prevent the light emitted from the first and second light emitting diodes L1, L2 from interfering with the driving circuit 400, it is necessary to design a separation interval between each of the first and second light emitting diode arrays LED1, LED2 and the driving circuit 400 to be a predetermined distance or more, such that the entire size of the lighting device 500 may be increased.

However, in the present exemplary embodiment, as described above, the driving circuit 400 is disposed between the first and second light emitting diode arrays LED1, LED2, that is, the driving circuit 400 is not located on a path of the light emitted from the first and second light emitting diodes L1, L2 on a plane to be output to the outside of the lighting device 500. Accordingly, the light emitted from the first and second light emitting diode arrays LED1, LED2 is prevented from interfering with the driving circuit 400, such that even if the first and second light emitting diodes L1, L2 are mounted on the circuit board 100 together with the driving circuit 400, the loss of the original directing angle of each of the first and second light emitting diodes L1, L2 may be minimized, thereby maximally implementing the irradiation range of the lighting device 500.

In the present exemplary embodiment, the connector CN may be disposed between the first and second light emitting diode arrays LED1, LED2. Accordingly, as in the case of the aforementioned driving circuit 400, the light emitted from the first and second light emitting diode arrays LED1, LED2 is prevented from interfering with the connector CN, such that the connector CN may minimize the decrease in the sizes of the first directing angle A1 and the second directing angle A2 or the change of ranges thereof.

Referring to FIGS. 5 and 6, the lighting device 501 according to the present exemplary embodiment includes the circuit board 100, the first light emitting diode array LED1, the second light emitting diode array LED2, the lens cover 300, a driving circuit 401, the connector CN, a thermal pad (not illustrated), a sealing member (not illustrated), and the heat sink 50. In describing FIGS. 5 and 6, reference numerals are denoted for the aforementioned components, and duplicate descriptions of the components are omitted.

In the present exemplary embodiment, the driving circuit 401 includes a converter 440, an illuminance sensor 450, and a dimming circuit 460.

The converter 440 converts an AC power provided from the outside through the connector CN into a DC power of a rated voltage. Further, the illuminance sensor 450 senses external illuminance, and the dimming circuit 460 adjusts power signals applied to the first and second light emitting diode arrays LED1, LED2 to control the illuminance of the light emitted from the first and second light emitting diodes L1, L2.

More specifically, the converter 440 converts the AC power AC provided from an external power supply apparatus into the DC power DC through the connector CN, and the DC power DC converted by the converter 440 is provided toward the dimming circuit 460.

Further, the illuminance sensor 450 receives an external light LT provided from the outside of the lighting device 501 to generate illuminance information S12 related to the external illuminance, and the illuminance information S12 is provided toward the dimming circuit 460.

The dimming circuit 460 controls the current values of a first power signal S21 and a second power signal S22 which are provided to the first and second light emitting diode arrays LED1, LED2 based on illuminance information S12. For example, if the illuminance information S12 is larger than a predetermined illuminance value, the dimming circuit 460 controls the current values of the first and second power signals S21, S22 to be substantially zero, such that the illuminance of the first light LT1 emitted from the light emitting diode arrays LED1 and the illuminance of the second light LT2 emitted from the second light emitting diode arrays LED2 may be substantially zero. Further, if the illuminance information S12 is smaller than the predetermined illuminance value, the dimming circuit 460 increases the current values of the first and second power signals S21, S22 to increase the illuminance of the first light LT1 and the second light LT2.

In the present exemplary embodiment, as in the aforementioned exemplary embodiment, the driving circuit 401 is disposed between the first and second light emitting diode arrays LED1, LED2. Further, as in the present exemplary embodiment, if the driving circuit 401 includes the converter 440, the illuminance sensor 450, and the dimming circuit 460, the converter 440, the illuminance sensor 450 and the dimming circuit 460 are arranged along a space between the first and second light emitting diode arrays LED1, LED2. Accordingly, the driving circuit 401 is not disposed on the path of the light which is emitted from the first and second light emitting diode arrays LED1, LED2 and emitted to the lighting device 501.

According to the aforementioned structure of the driving circuit 401, the light emitted from the first and second light emitting diodes L1, L2 is prevented from interfering with the driving circuit 401, such that even if the first and second light emitting diodes L1, L2 are mounted on the circuit board 100 together with the driving circuit 401, the loss of the original directing angle of each of the first and second light emitting diodes L1, L2 may be minimized, thereby maximally implementing the irradiation range of the lighting device 501.

As described above, although the present disclosure has been described with reference to the exemplary embodiments, it may be understood by those skilled in the art that the present disclosure may be modified and changed variously without departing from the spirit and scope of the present disclosure described in the appended claims.

The invention claimed is:

1. A lighting device comprising:

a circuit board;

a first light emitting diode array which is mounted on the circuit board to generate light, and arranged on the circuit board;

a second light emitting diode array which is mounted on the circuit board to generate light, and spaced apart from the first light emitting diode array to be arranged on the circuit board; and a driving circuit which is mounted on the circuit board to generate an electrical signal for driving the first light emitting diode array and the second light emitting diode array, and disposed between the first light emitting diode array and the second light emitting diode array, wherein the first light emitting diode array comprises first light emitting diodes which are arranged along a first side adjacently to the first side of the circuit board, and wherein the second light emitting diode array comprises second light emitting diodes which are arranged along a second side adjacently to the second side of the circuit board opposite to the first side, wherein the lighting device further comprises a lens cover including:

first optical lenses which cover the first light emitting diodes;

second optical lenses which cover the second light emitting diodes; and a cover which is formed integrally with the first optical lens and the second optical lens, wherein the cover has a convex shape corresponding to the location of the driving circuit to cover the driving circuit, wherein the cover is disposed between the first light emitting diode array and the second light emitting diode array, and, wherein the lens cover is formed as one member made of a material having a property of transmitting light.

2. The lighting device of claim 1, wherein the first light emitting diodes are arranged in a longitudinal direction of the circuit board adjacently to the first side, and the second light emitting diodes are arranged in the longitudinal direction of the circuit board adjacently to the second side.

3. The lighting device of claim 1, wherein the first side corresponds to one long side of the circuit board, and the second side corresponds to the other long side of the circuit board.

4. The lighting device of claim 1, wherein the driving circuit comprises a Rectifier circuit which rectifies an external alternating current power into a direct current power.

5. The lighting device of claim 4, further comprising a connector which is disposed on the circuit board to be electrically connected to the Rectifier circuit, and to which the external alternating current power is applied, wherein the connector is disposed between the first light emitting diode array and the second light emitting diode array.

6. The lighting device of claim 1, wherein the driving circuit comprises a converter which converts an alternating current power provided from the outside into a direct current power of a rated voltage.

7. The lighting device of claim 1, wherein the driving circuit comprises a dimming circuit which controls the illuminance of light emitted from the first light emitting diode array and the second light emitting diode array.

8. The lighting device of claim 7, wherein the driving circuit further comprises an illuminance sensor which senses an external illuminance, and wherein the dimming circuit controls the illuminance of the light emitted from the first light emitting diode array and the second light emitting diode array based on information of the external illuminance sensed by the illuminance sensor.

9. The lighting device of claim 1, wherein the driving circuit comprises a plurality of electronic elements, and wherein the plurality of electronic elements are arranged along a space between the first light emitting diode array and the second light emitting diode array.

* * * * *